US008939075B2

(12) United States Patent
Nishimoto

(10) Patent No.: US 8,939,075 B2
(45) Date of Patent: Jan. 27, 2015

(54) SCREEN PRINTING DEVICE SCRAPER

(75) Inventor: Yoichiro Nishimoto, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 0 days.

(21) Appl. No.: 13/997,281

(22) PCT Filed: Dec. 27, 2010

(86) PCT No.: PCT/JP2010/073566
§ 371 (c)(1),
(2), (4) Date: Jun. 24, 2013

(87) PCT Pub. No.: WO2012/090270
PCT Pub. Date: Jul. 5, 2012

(65) Prior Publication Data
US 2013/0269553 A1 Oct. 17, 2013

(51) Int. Cl.
*B41F 15/08* (2006.01)
*B41F 15/40* (2006.01)
*B41F 15/42* (2006.01)
*B41F 15/44* (2006.01)

(52) U.S. Cl.
CPC ..... *B41F 15/0818* (2013.01); *B41F 15/44* (2013.01)
USPC ..... 101/123; 101/114; 15/121

(58) Field of Classification Search
CPC ..... B41F 15/40; B41F 15/42; B41F 15/44; B41F 15/46; B41F 15/08; H05K 3/34; H05K 3/12; B41M 1/12; B41M 2215/13; B41M 2215/132; B41P 2200/40
USPC ..... 101/114, 119, 120, 123, 124, 364; 15/236.01, 236.05, 245, 245.1, 320, 15/401, 121
See application file for complete search history.

(56) References Cited

FOREIGN PATENT DOCUMENTS

| | | | |
|---|---|---|---|
| CN | 2758070 | Y | 2/2006 |
| JP | 62-94036 | U | 6/1987 |
| JP | 4-34184 | A | 2/1992 |
| JP | 4-341846 | A | 11/1992 |
| JP | 5-77393 | A | 3/1993 |
| JP | 6-182967 | A | 7/1994 |
| JP | 2004-160891 | A | 6/2004 |

(Continued)

OTHER PUBLICATIONS

Chinese Notification of the First Office Action dated Apr. 25, 2014 issued in the corresponding Chinese Patent Application No. 2010800709395 and English language translation (10 pages).
German Office Action dated Aug. 18, 2014 issued in the corresponding German Patent Application No. 112010006095.9 and English language translation (7 pages).

(Continued)

*Primary Examiner* — Leslie J Evanisko
*Assistant Examiner* — Marissa Ferguson Samreth
(74) *Attorney, Agent, or Firm* — Buchanan Ingersoll & Rooney PC

(57) ABSTRACT

A scraper central portion in which a first contact surface has a trapezoidal shape with a lower base longer than an upper base, and scraper end portions that extend and are bent from respective lateral sides of a trapezoidal shape of the scraper central portion to a side of the first contact surface, and that include second contact surfaces that come in contact with the coating material. A lower base of the scraper central portion and lower sides of the scraper end portions are on the same plane. In a state where the first contact surface is vertical to the surface of the screen plate, the lower base of the scraper central portion and the lower sides of the scraper end portions come in contact with the coating material on the surface of the screen plate, and slide on the surface of the screen plate.

8 Claims, 7 Drawing Sheets

(56) References Cited

FOREIGN PATENT DOCUMENTS

| | | | |
|---|---|---|---|
| JP | 2004-174736 | A | 6/2004 |
| JP | 2005-305909 | A | 11/2005 |
| JP | 2006-7605 | A | 1/2006 |
| JP | 2007-62018 | A | 3/2007 |
| JP | 2009-190368 | A | 8/2009 |
| JP | 4476041 | B2 | 6/2010 |

OTHER PUBLICATIONS

International Search Report (PCT/ISA/210) issued on Mar. 8, 2011, by the Japanese Patent Office as the International Searching Authority for International Application No. PCT/JP2010/073566.

Written Opinion (PCT/ISA/237) issued on Mar. 8, 2011, by the Japanese Patent Office as the International Searching Authority for International Application No. PCT/JP2010/073566.

Prior Notification of Rejection issued Mar. 13, 2013 in Taiwan Patent Application No. 100104075.

SCREEN PRINTING DEVICE SCRAPER

FIELD

The present invention relates to a scraper for a screen printing device.

BACKGROUND

In a screen printing device, first, a paste or ink coating material supplied on a screen plate is coated by a scraper evenly over the screen plate. A squeegee is then brought into contact with the screen plate and moved thereon, thereby printing a predetermined pattern on a printed material under the screen plate (see, for example, Patent Literature 1 and Patent Literature 2).

However, when such a scraper is used to repeat screen printing, the paste or ink coating material on the screen plate flows over and around both ends in the width-direction of the scraper to outside thereof. According to Patent Literature 1, it is supposed that the cause of this is that when both end portions of a scraper are solely bent inward relative to a traveling direction of the scraper, a coating material at the both end portions of the scraper only rolls up and down along a screen plate repeatedly, and therefore is not brought near a printing pattern portion on the screen plate.

The coating material flowing over and around the both ends of the scraper to the outside is left for a long time during an operation of the screen printing device. Therefore, due to causes such as significant changes in the viscosity by vaporization of volatile components of the coating material, the coating material cannot be reused. Accordingly, the flow of the coating material over and around the both ends of the scraper becomes a cause of the material loss.

Therefore, in order to solve this problem, there is proposed a screen printing device scraper that can reduce the material loss by reducing a flow amount of a coating material (see, for example, Patent Literature 1, Patent Literature 2, Patent Literature 3, and Patent Literature 4). For example, in Patent Literature 1, a member including an upwardly-inclined portion is attached to both ends of a scraper, thereby reducing a flow of a coating material from the both ends of the scraper. In Patent Literature 2, a sub-scraper is provided, thereby reducing a flow of a coating material over and around both ends of a scraper. In Patent Literature 3, individually-formed members are coupled with a predetermined gap therebetween, thereby reducing a flow of a coating material over and around both ends of a scraper. In Patent Literature 4, a pre-squeegee is provided to serve as a sub-scraper, thereby reducing a flow of a coating material over and around both ends of a scraper.

CITATION LIST

Patent Literatures

Patent Literature 1: Japanese Patent Application Laid-open No. 2004-174736

Patent Literature 2: Japanese Patent Application Laid-open No. 2004-160891

Patent Literature 3: Japanese Patent Application Laid-open No. 2005-305909

Patent Literature 4: Japanese Patent Application Laid-open No. 2007-062018

SUMMARY

Technical Problem

However, the techniques in Patent Literatures 1 to 4 relate to improvements by means of additionally providing a new member to a conventional scraper or screen printing device. Therefore, there is a problem of a lack of structural simplicity and cost increases.

The present invention has been achieved to solve the above problems, and an object of the present invention is to provide a screen printing device scraper that can reduce a flow of a coating material to outside of the scraper and that can be achieved with a simple structure at a low cost.

Solution to Problem

There is provided a scraper according to an aspect of the present invention for a screen printing device that slides in a predetermined direction over a surface of a flat screen plate on which a coating material is supplied to coat the coating material on the surface of the screen plate, the screen printing device scraper including: a scraper central portion in which a first contact surface that comes in contact with the coating material has a trapezoidal shape with a lower base longer than an upper base; and scraper end portions that extend and are bent from respective lateral sides of a trapezoidal shape of the scraper central portion to a side of the first contact surface, and that include second contact surfaces that come in contact with the coating material, wherein a lower base of the scraper central portion and lower sides of the scraper end portions are on a same plane, and in a state where the first contact surface is vertical to the surface of the screen plate, the lower base of the scraper central portion and the lower sides of the scraper end portions come in contact with the coating material on the surface of the screen plate, and slide on the surface of the screen plate.

Advantageous Effects of Invention

According to the present invention, it is possible to obtain a screen printing device scraper that can reduce the loss of a coating material by reducing a flow of the coating material over and around both end portions of the scraper to outside thereof and that can be realized with a simple structure at a low cost.

DESCRIPTION OF EMBODIMENTS

Exemplary embodiments of a screen printing device scraper according to the present invention will be explained below in detail with reference to the accompanying drawings. The present invention is not limited to the embodiments.

First Embodiment

Figure 1:
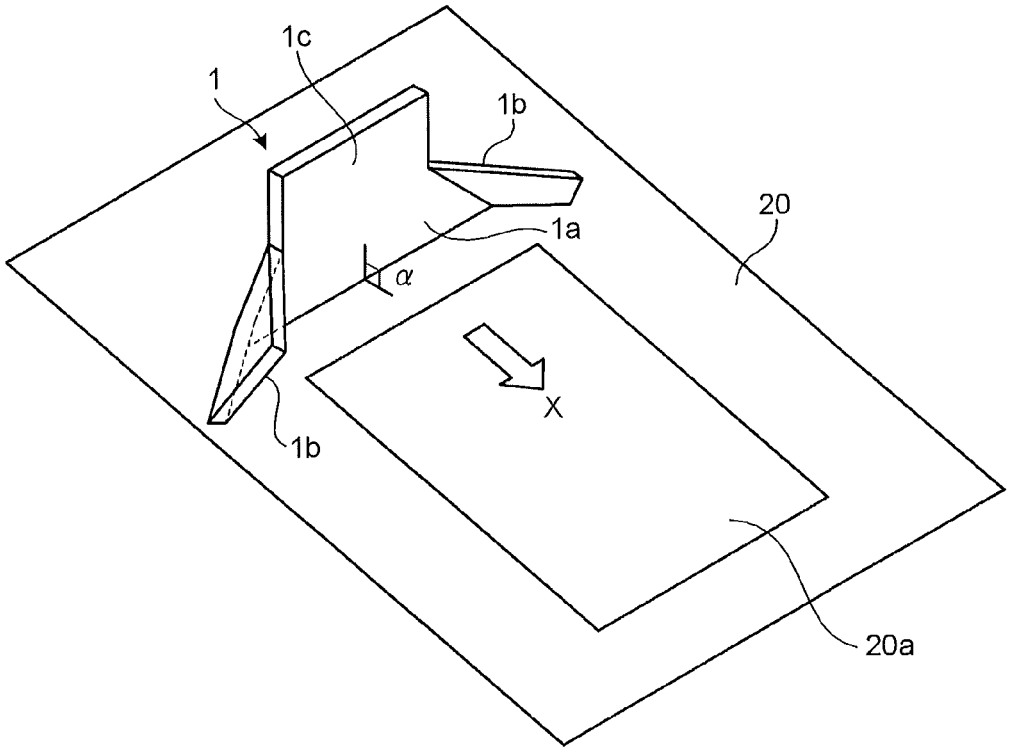
FIG. 1 is a perspective view of an external appearance of a screen printing device scraper according to a first embodiment of the present invention.

FIG. 1 is a perspective view of an external appearance of a screen printing device scraper 1 according to a first embodiment of the present invention. In the scraper 1 according to the first embodiment, scraper end portions 1*b* provided at both end portions of the scraper 1 are formed integrally with a scraper central portion 1*a* provided at the center of the scraper 1. Specifically, the scraper 1 is formed integrally by using one metal plate of stainless steel or the like, for example. The scraper 1 is used in a state where the scraper central portion 1*a* is set vertically to a screen plate 20. The material of the scraper 1 is not limited to metal, and other materials such as a resin material can also be used as long as the scraper 1 can function as a scraper.

The scraper central portion 1*a* has a trapezoidal shape defined by two lateral sides that form an inverted-V shape widening toward the bottom and by an upper base and a lower base that respectively connect between apexes of the lateral sides. That is, the scraper central portion 1*a* has a trapezoidal shape with the lower base longer than the upper base. The scraper central portion 1*a* is formed with its lower-base width corresponding to the width of a printing pattern portion 20*a* of the screen plate 20. On the upper base of the scraper central portion 1*a*, an attachment portion 1*c* attached to a scraper holder (not shown) that attaches the scraper 1 to the screen printing device is provided to extend upward in the plane direction of the scraper central portion 1*a*. In the scraper central portion 1*a*, a surface on a traveling direction X side of the scraper 1 is a surface that comes in contact with a coating material (first contact surface). When the scraper central portion 1*a* is set on the screen plate 20, an attack angle $\alpha$ that is an angle formed between the first contact surface and the screen plate 20 is 90 degrees.

The scraper end portions 1*b* are bent inward toward the traveling direction X of the scraper 1 from the respective lateral sides of the scraper central portion 1*a*, and are formed into a substantially rectangular-shaped flat surface. That is, the scraper end portions 1*b* extend and are bent from the lateral sides of the trapezoidal shape of the scraper central portion 1*a* to the first contact surface side. In the scraper end portions 1*b*, surfaces on the traveling direction X side of the scraper 1 are surfaces that come in contact with a coating material (second contact surfaces).

The scraper end portions 1*b* are provided while being bent from the respective lateral sides of the trapezoidal-shaped scraper central portion 1*a*, thereby causing the scraper end portions 1*b* to be inclined relative to the first contact surface of the scraper central portion 1*a*. Therefore, the scraper end portions 1*b* are inclined in a direction from an upper side to a lower side toward the rear in the traveling direction X of the scraper 1. Accordingly, when the first contact surface of the scraper central portion 1*a* is set vertically to the screen plate 20, the scraper end portions 1*b* have an inclination angle of 90 degrees or smaller relative to the screen plate 20. Lower sides of the scraper end portions 1*b* are provided to be positioned on the same plane as the lower base of the scraper central portion 1*a* in order that when the scraper 1 slides over the screen plate 20, the whole area of the lower sides and the lower base can come into contact with a coating material on the screen plate 20.

When screen printing is performed, the scraper 1 as described above is set on the screen plate 20 in order that the first contact surface of the scraper central portion 1*a* is vertical to the screen plate 20, and the upper base and the lower base of the scraper central portion 1*a* are orthogonal to the traveling direction X of the scraper 1. By sliding the scraper 1 over the screen plate 20 in the traveling direction X of the scraper 1, the screen plate 20 is evenly coated with a coating material of paste or ink that is supplied to the screen plate 20. At this time, the second contact surfaces of the scraper end portions 1*b* scrape the coating material present beyond the printing pattern portion 20*a* in a scraper width direction, and move the coating material to the center of the scraper central portion 1*a* in a width direction of the scraper 1. The scraper width direction is a direction of the lower base of the scraper central portion 1*a*.

Figure 2:
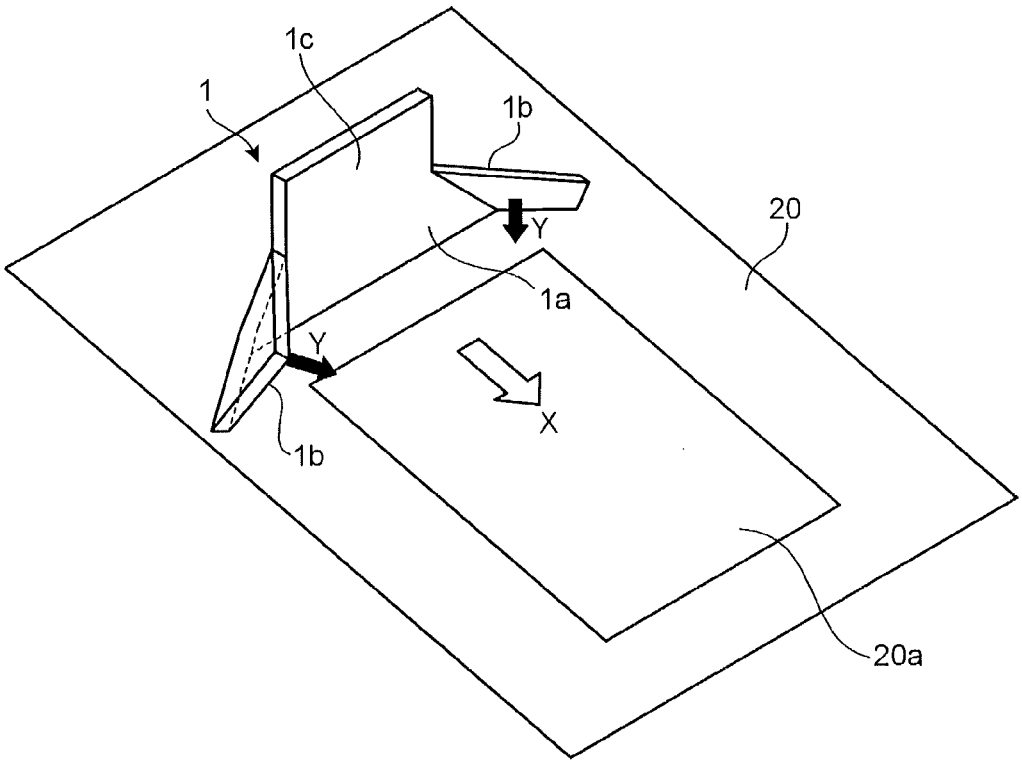
FIG. 2 is a schematic diagram for explaining a force applied to a coating material scraped by scraper end portions in the scraper according to the first embodiment.

In the scraper 1 according to the first embodiment as described above, the scraper end portions 1*b* extend and are bent from the respective lateral sides of the trapezoidal-shaped scraper central portion 1*a*, thereby causing the scraper end portions 1*b* to be inclined. Accordingly, when the first contact surface of the scraper central portion 1*a* is set vertically to the screen plate 20, the second contact surfaces of the scraper end portions 1*b* have an inclination angle of 90 degrees or smaller relative to the screen plate 20. When the scraper 1 as described above is slid in the traveling direction X of the scraper 1, a force diagonal to the traveling direction X of the scraper 1 (a force directed toward the scraper central portion 1*a* in the width direction of the scraper 1), as shown by arrows Y in FIG. 2, is applied to a coating material scraped near a boundary between the scraper central portion 1*a* and the scraper end portions 1*b*, and by the scraper end portions 1*b*. Therefore, there is an effect of reducing a flow of the coating material over and around the scraper end portions 1*b* to the outside of the scraper 1. FIG. 2 is a schematic diagram for explaining a force applied to a coating material scraped by the scraper end portions 1*b* in the scraper 1 according to the first embodiment.

Figure 3:
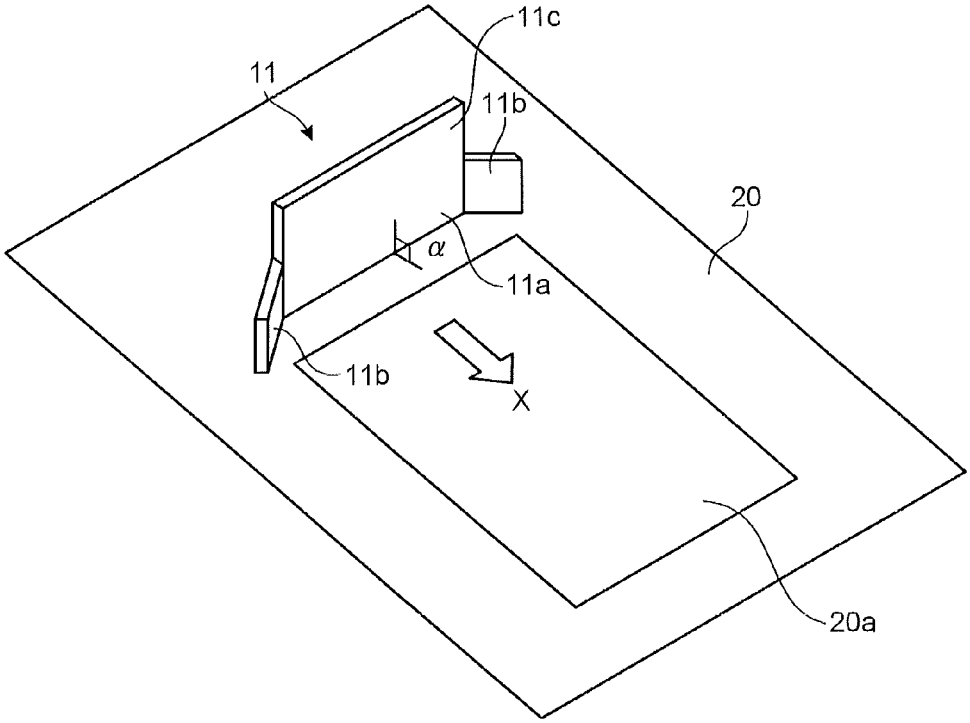
FIG. 3 is a perspective view of an external appearance of a conventional general scraper.

FIG. 3 is a perspective view of an external appearance of a conventional general scraper 11. In the scraper 11 shown in FIG. 3, flat scraper end portions 11*b* provided at both end portions of the scraper 11 are formed integrally with a flat scraper central portion 11*a* provided at the center of the scraper 11. In the scraper 11, a surface on a traveling direction X side of the scraper is a contact surface with a coating material. The scraper end portions 11*b* are bent inward toward the traveling direction X of the scraper 11 from respective lateral sides of the scraper central portion 11*a*, and are formed into a substantially rectangular-shaped flat surface. On an upper base of the scraper central portion 11*a*, an attachment portion 11*c* attached to a scraper holder (not shown) that attaches the scraper 11 to a screen printing device is provided to extend upward in the plane direction of the scraper central portion 11*a*. The scraper 11 is used in a state where the scraper central portion 11*a* and the scraper end portions 11*b* are set vertically to the screen plate 20.

Other than Patent Literatures 1 to 4 described above, Japanese Patent Application Laid-open No. 4-341846 and Japanese Utility Model Laid-open Publication No. 62-094036 also describe an example of a conventional scraper in which a scraper central portion is set at an attack angle of 90 degrees or smaller.

Figure 4:
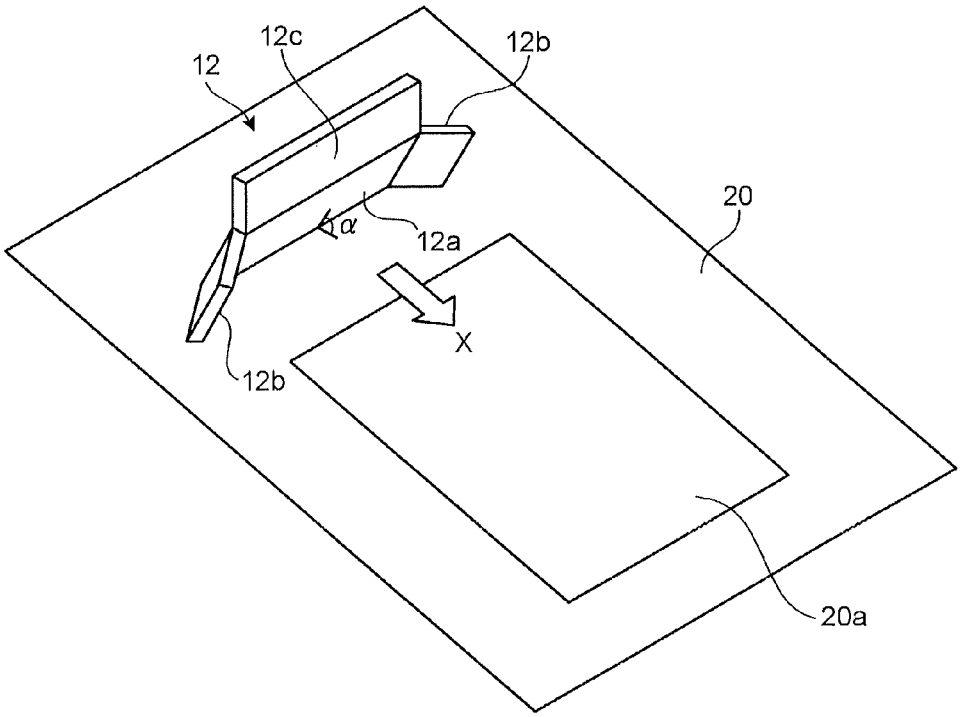
FIG. 4 is a perspective view of an external appearance of a scraper in which a conventional general scraper is combined with a technique described in Japanese Patent Application Laid-open No. 4-341846.

When the conventional general scraper 11 as described above is combined with a technique of forming an attack angle at 90 degrees or smaller, which is described in Japanese Patent Application Laid-open No. 4-341846, a scraper 12 having a structure as shown in FIG. 4 is obtained. FIG. 4 is a perspective view of an external appearance of the scraper 12 in which a conventional general scraper is combined with the technique described in Japanese Patent Application Laid-open No. 4-341846. In the scraper 12, scraper end portions 12*b* have an inclination angle of 90 degrees or smaller relative to the screen plate 20. Therefore, the scraper 12 can be expected to have an effect of reducing a flow of a coating material over and around the scraper end portions 12*b* to outside of the scraper 12. However, a significant difference between the scraper 1 according to the first embodiment and the scraper 12 is a behavior of a coating material scraped near a boundary between a scraper central portion and scraper end portions.

Figure 5:
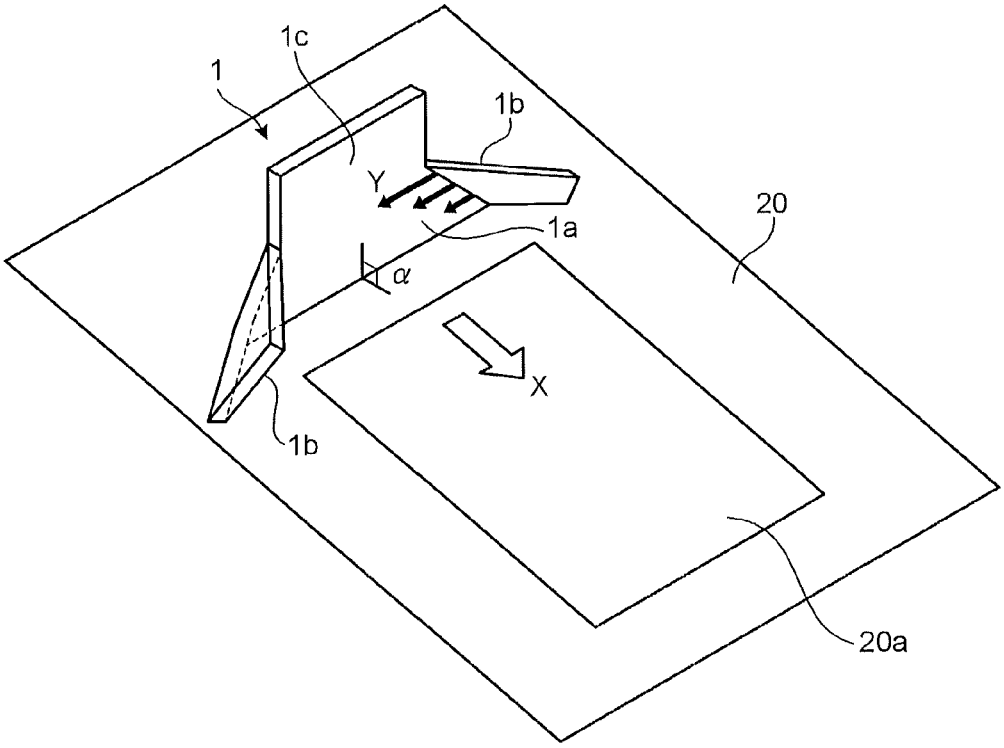
FIG. 5 is an explanatory diagram of a force applied to a coating material scraped near a boundary between a scraper central portion and scraper end portions in the scraper according to the first embodiment.
Figure 6:
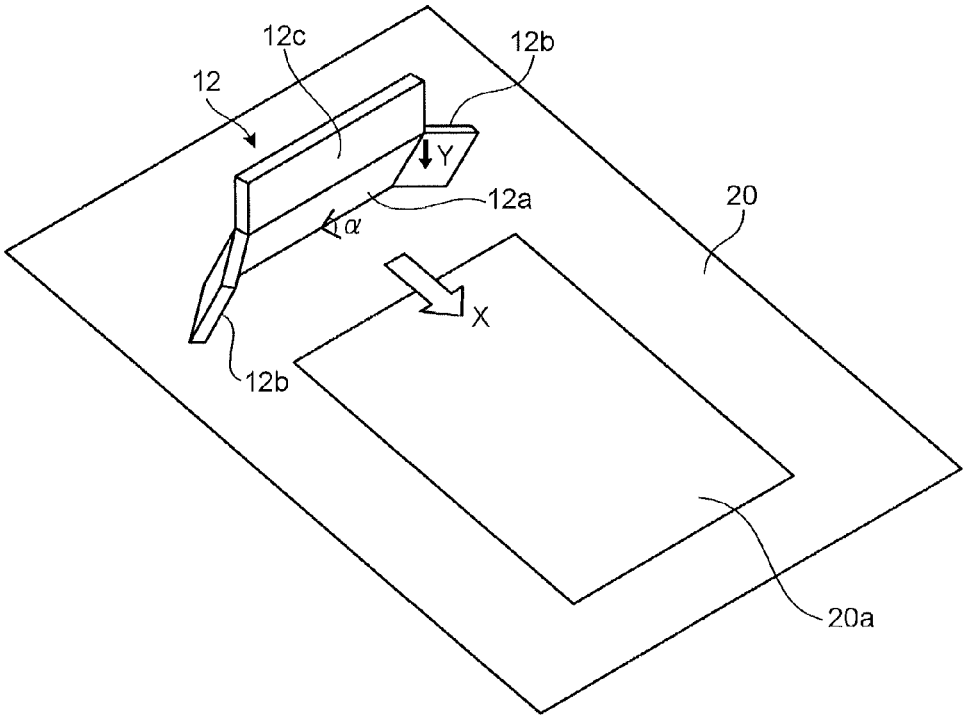
FIG. 6 is an explanatory diagram of a force applied to a coating material scraped near a boundary between a scraper central portion and scraper end portions in a scraper 12.

The difference between the scraper 1 according to the first embodiment and the scraper 12 is explained with reference to FIGS. 5 and 6. FIG. 5 is an explanatory diagram of a force applied to a coating material scraped near a boundary between the scraper central portion 1*a* and the scraper end portions 1*b* in the scraper 1 according to the first embodiment. FIG. 6 is an explanatory diagram of the scraper 12, in which a force is applied to a coating material scraped near a boundary between a scraper central portion 12*a* and the scraper end portions 12*b*.

In the scraper 12, a force diagonal to the traveling direction X of a scraper is applied to a coating material scraped by the scraper end portions 12*b*. Although a downward force shown by an arrow Y in FIG. 6 is applied to a coating material scraped near the boundary between the scraper central portion 12*a* and the scraper end portions 12*b*, a lateral-direction force is not applied thereto. Therefore, the coating material scraped by this area only moves while being rolled in the traveling direction X of the scraper. That is, the coating material scraped near the boundary between the scraper central portion 12*a* and the scraper end portions 12*b* is rolled back on the screen plate 20. This coating material is scraped again near the boundary between the scraper central portion 12*a* and the scraper end portions 12*b*, and only moves in the traveling direction X of the scraper. In this case, when an amount of the coating material scraped by the scraper 12 is increased, the coating material is not really prevented from flowing over and around the scraper end portions 12*b* to the outside of the scraper 12.

On the other hand, the scraper 1 according to the first embodiment includes the trapezoidal-shaped scraper central portion 1*a* and the scraper end portions 1*b* that extend and are bent inward toward the traveling direction X of the scraper 1 from the respective lateral sides of the scraper central portion 1*a*. Therefore, as shown by the arrows Y in FIG. 5, a force is applied to a coating material scraped by a boundary portion between the scraper central portion 1*a* and the scraper end portions 1*b* to move the coating material to the center of the scraper central portion 1*a* in the width direction of the scraper 1. This force increases as there are more deposits of a coating material. Therefore, in the scraper 1 according to the first embodiment, an effect of moving the coating material, scraped by the boundary portion between the scraper central portion 1*a* and the scraper end portions 1*b*, to the center of the scraper central portion 1*a* in the width direction of the scraper 1 is more significant than that in the scraper 12 in which the conventional scraper 11 is solely combined with the technique described in Japanese Patent Application Laid-open No. 4-341846. That is, in the scraper 1, an effect of reducing a flow of a coating material over and around the scraper end portions 1*b* to the outside of the scraper 1 is substantially enhanced as compared to that in the scraper 12.

As described above, the scraper 1 according to the first embodiment includes the trapezoidal-shaped scraper central portion 1*a* and the scraper end portions 1*b* that extend and are bent inward toward the traveling direction X of the scraper 1 from the respective lateral sides of the trapezoidal-shaped scraper central portion 1*a*. Accordingly, the scraper 1 can apply a force to a coating material scraped by the boundary portion between the scraper central portion 1*a* and the scraper end portions 1*b* to move the coating material in a direction of the center of the scraper central portion 1*a* in the width direction of the scraper 1. Therefore, the scraper 1 according to the first embodiment can reliably reduce a flow of the coating material over and around the scraper end portions 1*b* to the outside of the scraper 1.

Further, the scraper 1 according to the first embodiment is formed integrally by changing a scraper shape itself in contrast to the proposals in Patent Literatures 1 to 4 in which new members are added to an existing configuration. Therefore, the scraper 1 can be manufactured simply from, for example, one metal sheet at a low cost, similarly to a conventional general scraper. To obtain the above effects of the scraper 1, it suffices that contact surfaces with a coating material satisfy the conditions described above. Therefore, a configuration on a back side of the scraper 1, that is, a configuration of a surface on the opposite side to the traveling direction X is not particularly limited.

Second Embodiment

Figure 7:
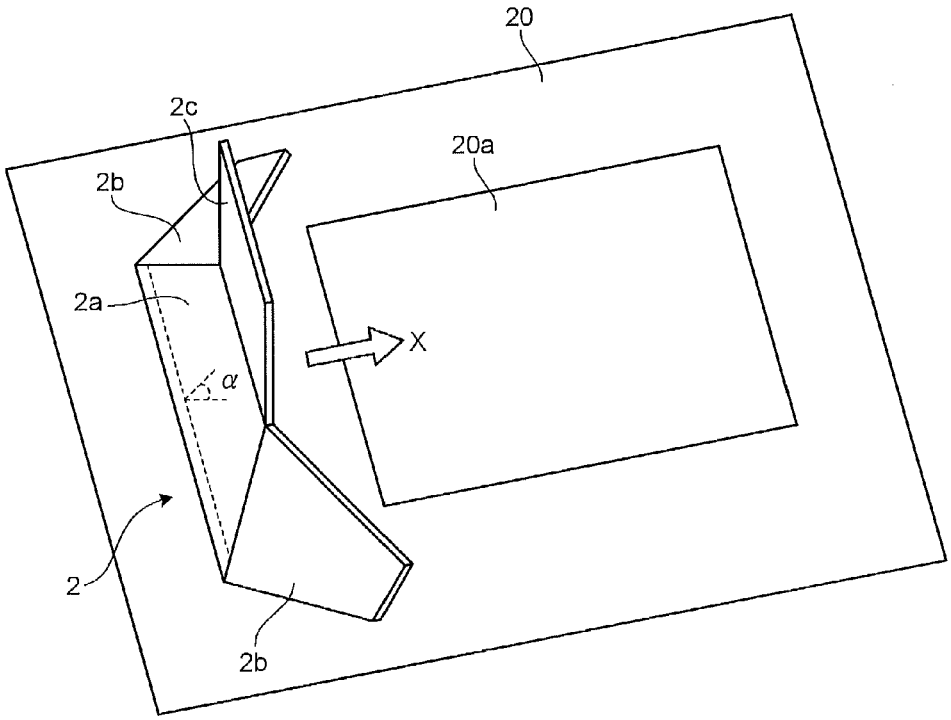
FIG. 7 is a perspective view of an external appearance of a screen printing device scraper according to a second embodiment of the present invention.

FIG. 7 is a perspective view of an external appearance of a screen printing device scraper 2 according to a second embodiment of the present invention. The scraper 2 according to the second embodiment has a structure, with the scraper 1 according to the first embodiment as a basic configuration, in which a scraper central portion 2*a* is inclined in order that the attack angle $\alpha$ is an acute angle. That is, the scraper 2 according to the second embodiment includes the trapezoidal-shaped scraper central portion 2*a* and scraper end portions 2*b* that extend and are bent inward toward a traveling direction X of the scraper 2 from respective lateral sides of the scraper central portion 2*a*. On an upper base of the scraper central portion 2*a*, an attachment portion 2*c* attached to a scraper holder (not shown) that attaches the scraper 2 to a screen printing device is provided to extend upward. When the scraper central portion 2*a* is set on the screen plate 20, the attack angle $\alpha$ that is an angle formed between a contact surface with a coating material and the screen plate 20 is an acute angle.

In the scraper 2 according to the second embodiment as described above, because the attack angle a is an acute angle, a scraped coating material is easily rolled, and an amount of the coating material filled in a pattern provided on the screen plate 20 is increased. As a result, there is an effect of easily obtaining a desired printing shape.

Further, in the scraper 2 according to the second embodiment, even when the attack angle $\alpha$ is an acute angle, an effect of moving a coating material to the scraper central portion 2*a*, which is obtained from the scraper end portions 2*b* and near a boundary between the scraper central portion 2*a* and the scraper end portions 2*b*, remains unchanged as compared to that in the scraper 1 according to the first embodiment. Therefore, the scraper 2 according to the second embodiment can reliably reduce a flow of a coating material over and around the scraper end portions 2*b* to the outside of the scraper 2, similarly to the scraper 1 according to the first embodiment.

Further, the scraper 2 according to the second embodiment is also formed integrally by changing a scraper shape itself in contrast to the proposals in Patent Literatures 1 to 4 in which new members are added to an existing configuration. Therefore, the scraper 2 can be manufactured simply from, for example, one metal sheet at a low cost, similarly to a conventional general scraper.

INDUSTRIAL APPLICABILITY

As described above, the screen printing device scraper according to the present invention is useful in reducing the material loss and cost in screen printing.

REFERENCE SIGNS LIST

1 scraper
1*a* scraper central portion
1*b* scraper end portion
1*c* attachment portion to scraper holder
2 scraper
2*a* scraper central portion
2*b* scraper end portion
2*c* attachment portion to scraper holder
11 scraper
11*a* scraper central portion
11*b* scraper end portion
11*c* attachment portion to scraper holder
12 scraper
12*a* scraper central portion
12*b* scraper end portion
20 screen plate
20*a* printing pattern portion
$\alpha$ attack angle

The invention claimed is:

1. A scraper for a screen printing device that slides in a predetermined direction over a surface of a flat screen plate on which a coating material is supplied to coat the coating material on the surface of the screen plate, the screen printing device scraper comprising:

a scraper central portion in which a first contact surface that comes in contact with the coating material has a trapezoidal shape with a lower base longer than an upper base; and scraper end portions that extend and are bent from respective lateral sides of a trapezoidal shape of the scraper central portion to a side of the first contact surface, and that include second contact surfaces that come in contact with the coating material, wherein a lower base of the scraper central portion and lower sides of the scraper end portions are on a same plane, and in a state where the first contact surface is vertical to the surface of the screen plate, the lower base of the scraper central portion and the lower sides of the scraper end portions come in contact with the coating material on the surface of the screen plate, and slide on the surface of the screen plate.

2. The screen printing device scraper according to claim 1, wherein the screen printing device scraper is formed integrally from one metal plate.

3. The screen printing device scraper according to claim 1, wherein the scraper end portions are inclined relative to the first contact surface of the scraper central portion so that the scraper end portions are bent in a direction downward toward a lower portion of the scraper.

4. The screen printing device scraper according to claim 1, wherein the scraper end portions are bent forward relative to the scraper central portion such that when the first contact surface of the scraper central portion is set vertically onto the screen plate, the scraper end portions have an inclination angle of less than 90 degrees relative to the screen plate.

5. A scraper for a screen printing device that slides in a predetermined direction over a surface of a flat screen plate on which a coating material is supplied to coat the coating material on the surface of the screen plate, the screen printing device scraper comprising:

a scraper central portion in which a first contact surface that comes in contact with the coating material has a trapezoidal shape with a lower base longer than an upper base; and scraper end portions that extend and are bent from respective lateral sides of a trapezoidal shape of the scraper central portion to a side of the first contact surface, and that include second contact surfaces that come in contact with the coating material, wherein a lower base of the scraper central portion and lower sides of the scraper end portions are on a same plane, and in a state where the first contact surface forms an acute angle relative to the surface of the screen plate, the lower base of the scraper central portion and the lower sides of the scraper end portions come in contact with the coating material on the surface of the screen plate, and slide on the surface of the screen plate.

6. The screen printing device scraper according to claim 5, wherein the screen printing device scraper is formed integrally from one metal plate.

7. The screen printing device scraper according to claim 5, wherein the scraper end portions are inclined relative to the first contact surface of the scraper central portion so that the scraper end portions are bent in a direction downward toward a lower portion of the scraper.

8. The screen printing device scraper according to claim 5, wherein the scraper end portions are bent forward relative to the scraper central portion such that when the first contact surface of the scraper central portion is set onto the screen plate, the scraper end portions have an inclination angle of less than 90 degrees relative to the screen plate.

* * * * *